United States Patent [19]

Guilloteau et al.

[11] 4,310,034

[45] Jan. 12, 1982

[54] JOINING APPARATUS BETWEEN A TRANSPORTATION CONTAINER AND A HORIZONTAL WALL OF A DISCHARGE

[75] Inventors: Rene Guilloteau, Verrieres le Buisson; Jacques Segui, Fresnes, both of France

[73] Assignee: Commissariat a l'Energie Atomique, Paris, France

[21] Appl. No.: 17,900

[22] Filed: Mar. 6, 1979

[30] Foreign Application Priority Data

Mar. 9, 1978 [FR] France ..... 78 06821

[51] Int. Cl.[3] ..... B65B 1/28

[52] U.S. Cl. ..... 141/98; 141/348; 141/392; 376/203; 376/260

[58] Field of Search ..... 141/1, 93, 97, 98, 311 R, 141/321, 348, 383–386, 392; 176/30; 250/506, 507; 294/86 A; 414/146

[56] References Cited

U.S. PATENT DOCUMENTS

| | | | |
|---|---|---|---|
| 3,765,549 | 10/1973 | Jones | 176/30 X |
| 3,838,289 | 9/1974 | White | 250/507 X |
| 3,847,734 | 11/1974 | Schwarz | 414/146 X |

*Primary Examiner*—Frederick R. Schmidt

*Attorney, Agent, or Firm*—Kerkam, Stowell, Kondracki & Clarke

[57] ABSTRACT

Joining apparatus between a container equipped in its upper part with a plug and the wall of a discharge enclosure provided with a horizontal orifice in the lower part thereof and located above said container, wherein the container is provided in its upper part with an adapting ring with respect to said wall and a second protective ring for the plug and the orifice is sealed by a detachable cover having gripping means and resting on a seat connected to said wall of the discharge enclosure.

The apparatus is used for the dry transfer of fuel elements or nuclear waste to a reprocessing plant.

12 Claims, 10 Drawing Figures

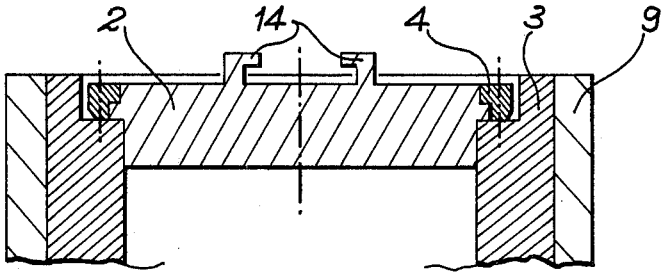
FIG. 3
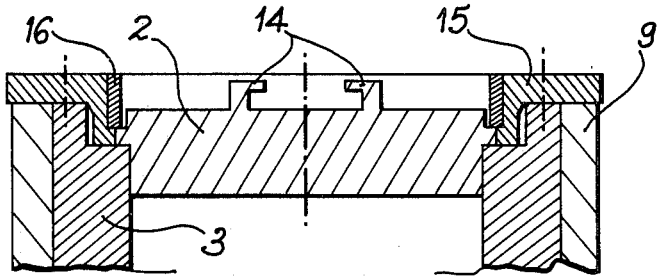
FIG. 4
FIG. 5
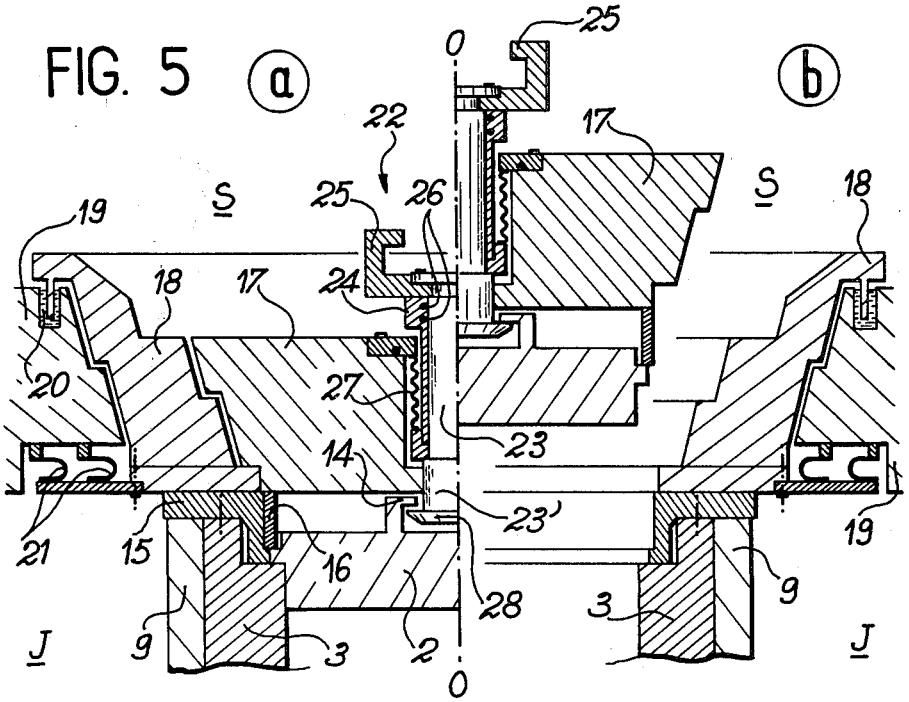

FIG. 5'a

JOINING APPARATUS BETWEEN A TRANSPORTATION CONTAINER AND A HORIZONTAL WALL OF A DISCHARGE

BACKGROUND OF THE INVENTION

The invention relates to a joining apparatus between a transportation container and a horizontal wall of a discharge enclosure which can in particular be used for effecting the discharge of lead containers into which have been loaded irradiated nuclear fuel elements after combustion in nuclear reactors. This apparatus can in particular be used for the dry transfer of fuel elements or nuclear waste to a reprocessing plant.

Irradiated fuel elements are generally discharged from such containers by the wet route using the process known under the name "pond discharge". This process makes it possible to solve in a relatively satisfactory manner certain of the radioactive contamination problems liable to occur during unloading operations. However, it has a certain number of disadvantages. Thus, it involves a complex succession of operations, part of which being inherent in the use of the wet route. This is particularly the case with regard to the operations of fitting and removing the protective skirts with which the containers must be covered when it is in the pond, as well as rinsing operations with water under high pressure aand decontamination operations effected by manual wiping of the wet parts. Pond discharge also involves the use of a large amount of equipment, such as the actual ponds and their accessory equipment, the protective skirts and a very extensive pipe system whose cumulative contamination causes problems. Due to the number and complexity of the operations and the large volume of equipment the known wet route processes require a considerable installation area. All these factors make the struggle against the spreading of radioactive contamination more difficult and more complex and thus tend to cancel out to a certain extent the advantages expected in this field from wet route processes.

Moreover pond discharge involves high manpower costs and the putting out of operation of the container for a very long period. The latter obviously has an unfavourable effect on the economic balance of the discharge process, because lead containers used for nuclear fuels are extremely costly and involve high investment expenditure. Moreover these very high manpower and immobilisation costs are subject to fluctuations because the duration of certain operations varies greatly as a function of the state of the products to be processed. These fluctuations are extremely disadvantageous with respect to the establishment and adherence to a rational operating programme.

These disadvantages which have been established during long-term experience with wet route processes have led to research being carried out on dry route discharge solutions which make it possible to significantly simplify the operating process and to greatly reduce investment costs, but which have been previously avoided through the absence of means making it possible to confine the radioactive contamination.

BRIEF SUMMARY OF THE INVENTION

The problem of the present invention is to provide an apparatus for the dry discharge of containers used for the transportation of radioactive substances and which, whilst permitting considerable simplifications to the operating procedure compared with known processes and correspondingly reducing manpower costs, the immobilisation times of the containers and in general terms investment costs and operating expenditure, still ensures a rigorous confinement of the contamination, thus providing absolute security to the personnel, even in the case when the operations involve close proximity action. Moreover the apparatus is constructed in such a way that in as simple a manner as possible it is optionally possible to use remotely controlled equipment enabling personnel to carry out the different operations from a distance and with absolute security. However, said remote control installation does not form part of the present invention which is limited to the actual apparatus, whose construction and use procedures will be described hereinafter.

According to the invention this problem is solved by an apparatus permitting the dry discharge of containers used for the transportation of radioactive substances and in particular lead containers containing nuclear fuels, wherein it comprises at least one container adapting ring and at least one ring for protecting the container plug placed in the upper part of the latter, the protective ring resting both on a shoulder of the adapting ring and on a shoulder of the container plug, a cover placed in a cover seat itself disposed in an orifice of a horizontal wall to which it is connected by deformable sealing means, the cover being provided in its median zone with a gripping device which traverses it in a tight manner whilst being able to slide vertically with respect to the cover in such a way that it is able to seize the plug of a container centred below the cover and whose protective plate is in contact by its upper face with the lower face of the cover seat and is able to raise the latter at the same time as the cover which rests thereon via the protective ring, joints being placed between the container and the adapting ring and between the latter and the cover seat to protect the upper part and the outer faces of the container from contamination, whilst at least two other joints are placed between the protective ring on the one hand and the adapting ring, together with the plug and the cover on the other in order to confine the contamination to the interface of the two rings and prevent the contamination of the upper part of the plug and the space defined by said plug, the cover and the protective ring, other joints being provided between the cover and its seat so as to confine to the greatest extent possible the contamination to the interface of the cover and its seat, means also being provided to flush with a fluid the unconfined portion of said interface space, whilst there is a funnel with a detachable bottom to protect the inner faces of the cover seat and the adapting ring during discharge and a receptacle can be placed beneath the cover and its seat when the container is absent.

BRIEF DESCRIPTION OF THE DRAWINGS

The invention will be described in greater detail hereinafter relative to non-limitative embodiments and the attached drawings, wherein show:

FIG. 3 a longitudinal section through the diametrical plane II—II of FIG. 2 of the upper part of the container free from its protective accessories with which it is equipped during transportation.

FIG. 4 a longitudinal section, identical to that of FIG. 3, of the upper part of the container of FIG. 1, the fixing ring and the cover protection system being removed and the adapting ring and the protective ring of the plug being fitted.

FIGS. 5*a* and 5'*a* are longitudinal half-sections through a diametrical plane of the upper part of the container in the state shown in FIG. 4, but the upper faces of the adapting ring and the plug protecting ring are in contact with the cover seat and the cover is resting on its seat.

FIG. 5*b* is a longitudinal half-section through a diametrical plane of the upper part of the container, the latter being in the same position as in FIG. 5*a*, but the cover and the container plug are removed.

DETAILED DESCRIPTION OF THE PREFERRED EMBODIMENTS

Figure 1:
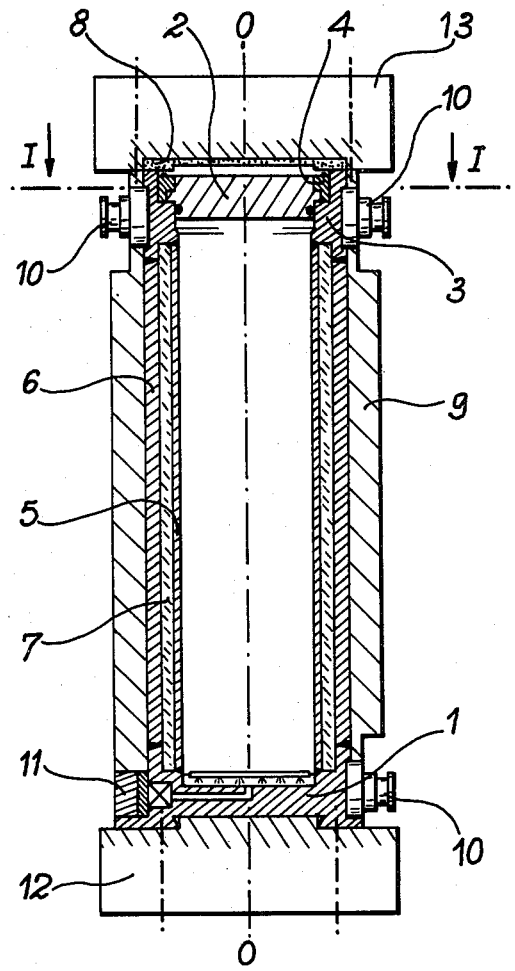
FIG. 1 a longitudinal section through a diametrical plane of the lead container, designated more simply hereinafter by the term container and serving for the transportation of radioactive substances and equipped with all the accessories protecting it during the transportation.
Figure 2:
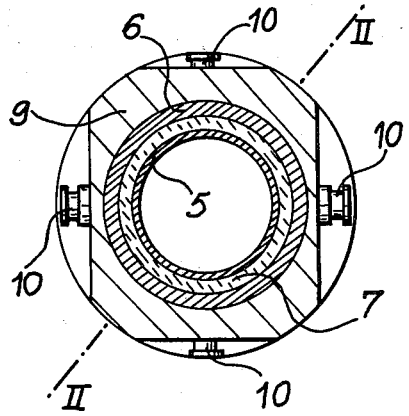
FIG. 2 a cross-section along the line I—I of the container of FIG. 1.

The per se known container which does not form part of the present invention is shown in a highly simplified and diagrammatic manner in FIGS. 1 and 2. It essentially comprises a steel tank having a circular cross-section shown in FIG. 1 with its vertical axis of revolution O—O, the lower part of the tank being sealed by a solid base 1 and its upper part by an also solid plug 2 placed on a ring 3 and maintained in place by a mounting flange 4 screwed to ring 3. The side wall of the composite tank comprises on its inner face a relatively thin steel ferrule 5 and on its outer face by a thick steel ferrule 6, whereby a thickness of lead 7 is inserted between the ferrules 5 and 6. Ferrules 5 and 6 are fixed on the one hand to base 1 and on the other to ring 3, ferrule 5 being in particular sealingly welded with its parts, whilst at least one joint ensures the tight sealing of plug 2 with respect to ring 3. The sealing of the container is completed by a sealing stopper 8 screwed to the upper face of ring 3 with the interpositioning of a gasket. A lateral external structure 9 enveloping the ferrule 6 essentially has means facilitating the evacuation of the heat produced within the inner cavity of the container by the radioactive substances contained therein (and which are not shown in the drawings). Handling operations are permitted by providing pivot pins 10, of which there are generally four in the upper part of the container and two in the lower part. In FIG. 1 the left-hand lower pivot pin 10 has been omitted to make it possible to see the decompression valve 11 of the container.

During transportation the container is also protected by a lower cap 12 and an upper cap 13 made from a shock-absorbing material.

When the container arrives at the discharge shop the protective accessories with which it was equipped during transportation, namely the upper and lower caps 13 and 12, together with the sealing stopper 8 are removed. Following these preliminary operations, which are mentioned here for information purposes only because they do not relate to the subject matter of the invention, the upper part of the container, whose axis is assumed to be vertical is in the form shown very diagrammatically in FIG. 3. FIG. 3 shows clips or clamps 14 fixed to the upper face of plug 2, which permit the handling operations of the latter. For reasons of clarity these clips 14 are not shown in FIG. 1 which is on a smaller scale.

FIG. 4, which is identical to FIG. 3, shows the plug mounting flange 4 unscrewed and removed, whilst an adapting ring 15 and a protective ring 16 of plug 2 have been fitted. Adapting ring 15 and protective ring 16 for plug 2 forms part of the apparatus according to the invention.

The apparatus according to the invention will now be described with reference to FIGS. 5*a*, 6 and 7.

FIG. 5*a* shows the container components shown in FIG. 4, namely the lateral envelopes 3 and 9, the plug 2 with its clips 14, the adapting ring 15 and the protective ring 16 of plug 2.

This assembly has been brought beneath a cover 17 and a cover seat 18, then centred and raised up to the upper face of the adapting ring 15 and the upper face of the protective ring 16 of plug 2 and respectively in contact with the lower face of cover seat 18 and the lower face of cover 17. Cover 17 rests on its seat 18 and the latter is sealingly connected to a floor 19, said tight connection being effected by on the one hand a hydraulic joint 20 and on the other by bellows 21 which permit a certain degree of mobility in the vertical direction between cover seat 18 and floor 19, without there being any deterioration in the sealing of the connection between said seat and said floor.

In the positions occupied in FIG. 5*a* cover 17, cover seat 18 and floor 19 sealingly separate a lower cell J which contains the container and an upper cell S which more particularly contains the not shown equipment permitting the discharge from the container of the radioactive substances contained therein.

FIG. 5*a* also shows a gripping device, designated overall by the reference numeral 22 and which essentially comprises a vertical circular shaft 23 coaxial to cover 17 which it traverses within a sleeve 24. Sleeve 24 is maintained on shaft 23 between a system of clips 25 fixed to the upper end of said shaft and a larger diameter portion 23' forming the lower end of shaft 23. Thus, there can be no relative vertical displacement between shaft 23 and sleeve 24, but only a relative displacement in rotation with the interpositioning of O-rings 26. However, sleeve 24 is able to move slightly in the vertical direction with respect to the cover 17 due to the bellows 27 which, during this displacement, maintains the sealing between sleeve 24 and cover 17. To the lower end 23' of shaft 23 are fixed clips 28, which are regularly distributed about the axis O—O, which is then common to the container and to the cover. As will be shown hereinafter said clips can engage with the clips 14 fixed to the plug 2 of the container and which are also regularly distributed about the axis O—O.

Figure 6:
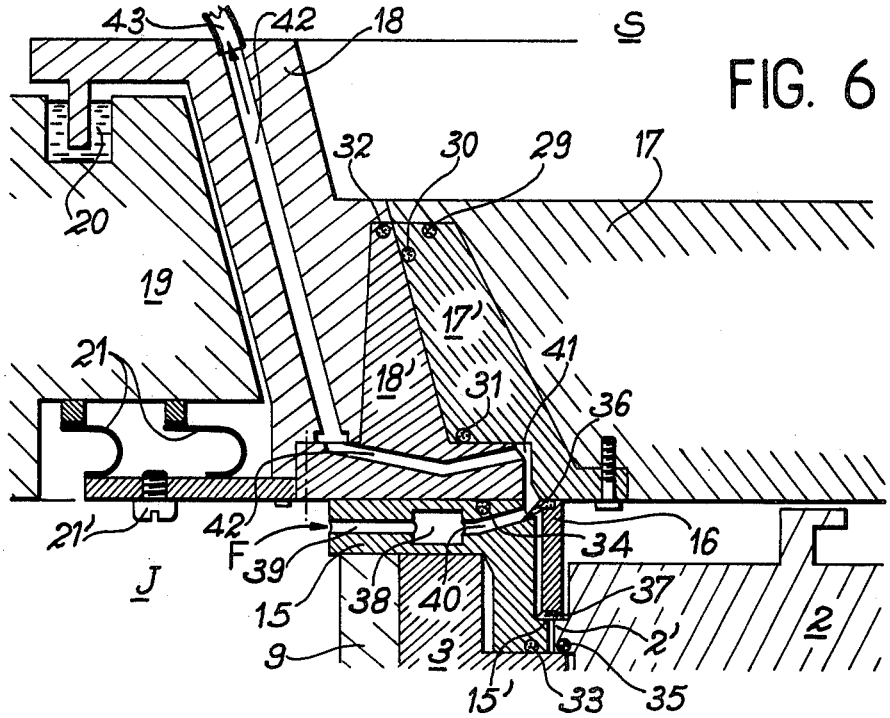
FIG. 6 corresponds with a larger scale and with greater detail to FIG. 5*a*.

FIG. 6 is a larger scale reproduction of FIG. 5*a*. For simplification purposes the gripping device 22 described hereinbefore is not shown in FIG. 6, which never the less shows details not shown in FIG. 5*a*.

FIG. 6 shows that cover 17 has a joined ring 17' and that cover seat 18 has a joined ring 18', rings 17' and 18' being respectively held by screwing on the cover and on the seat. Between the joined ring 17' and cover 17 is provided joint 29, whilst between ring 17' and the cover seat are provided joints 30 and 31. Joint 32 is located between the joined ring 18' and cover seat 18. Joint 33 and 34 respectively are located between adapting ring 15 and container 3, as well as cover seat 18. Joint 35 is positioned between plug 2 and container 3. Finally a lipped joint 36 is provided for sealing purposes between on the one hand the plug protection ring 16 and on the other ring 17' of cover 17 and adapting ring 15. Another lipped joint 37 ensures the sealing between on the one hand ring 16 and on the other plug 2 and adapting ring 15.

Within the adapting ring 15 is provided an annular cavity 38 which can be supplied from the outside from cell J by means of at least one orifice 39 and which, via numerous channels 40 distributed over the periphery is linked with the space 41 between the cover and its seat. This same space 41 is linked via at least one channel 42 with at least one orifice 43 issuing into the upper cell S. Thus, by means of external pipes sealingly connected on the one hand to orifices 39 and on the other to orifices 43 it is possible for a fluid to circulate in space 41.

Figure 7:
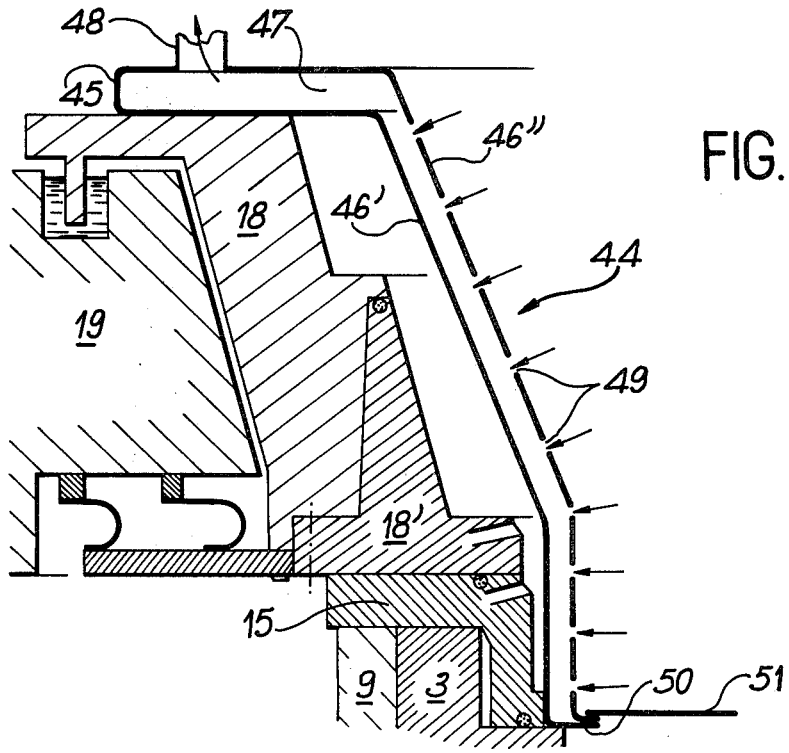
FIG. 7 corresponds on a larger scale to FIG. 5*b*, the container plug and the cover being completely removed and a protective funnel being fitted.

FIG. 7 shows a funnel, designated by the overall reference numeral 44, introduced into the opening of the cover seat 18 and an adapting ring 15 and whose upper horizontal edge 45 bears on the cover seat 18. This funnel is double-walled 46', 46'' with consequently an inner space 47 connected in its upper part to at least one not shown suction device by at least one tube 48. Orifices 49, made in the inner wall 46'' of funnel 44, make it possible when the suction device is operating to suck air and also the dust which it maintains in suspension into the central zone of funnel 44. At the lower end of funnel 44 is provided a ledge 50 on which can be placed a sealing base 51.

In summarising the apparatus according to the invention comprises the assembly formed by the adapting ring 15, the plug protecting ring 16, the cover 17, the cover seat 18, the funnel 44 and at the same time comprises all the accessory equipment, such as the gripping devices, joints, pipes, etc. associated with each of the main components described hereinbefore.

The apparatus according to the invention operates in the following manner:

On arriving at the reprocessing shop the container which is for example filled with irradiated nuclear fuel is freed from its protective accessories such as the upper and lower protective caps, sealing stopper, etc. With the container in the vertical position the screws of the plug mounting flange 4 are unscrewed and the flange 4 is removed. The adapting ring 15 is then fitted to the upper end of the container by screwing and then the protective ring 16 is introduced into ring 15 to rest on shoulder 15' thereof and simultaneously on a shoulder 2' of the container plug 2. The differences in level between the shoulders 15' and 2', due to constructional tolerances, are absorbed by the elastic deformation of the joint 37.

The container is then located in the state shown in FIG. 4 and it can only be moved by maintaining its axis at least approximately vertical, plug 2 being maintained in place by its own weight, to which is added that of the protective ring 16.

The container is placed vertically on a trolley, which is not described in detail here because it does not form part of the invention, but which permits:

the displacement of the container on a horizontal surface to bring it beneath the cover 17 and the seat 18 of the latter;

the horizontal regulation of the upper faces of rings 15 and 16;

the precise centring of the container with respect to the cover, for example by means of centring trolleys on which also directly rests the main trolley;

the raising of the container to bring the upper face of the adapting ring 15 into contact with the lower face of cover seat 18 in order to preferably slightly raise the latter.

When these operations have been performed the relative positions of the container on the one hand, the cover and its seat on the other are those shown in FIGS. 5*a* and 6. The slight raising of seat 18 by the adapting ring 15, which helps to provide a sealing contact between said two members, is permitted by hydraulic joint 20 and bellows 21. In the same way this hydraulic joint and these bellows permit a slight inclination of the cover seat 18 in the case where ring 15 is not strictly horizontally adjusted.

During the raising of the container it is ensured that the clips 28 placed in the lower part of gripping device 22 penetrate the gaps which between them separate the clips 14 of plug 2 of the container.

Starting from the position shown in FIGS. 5*a* and 6 the following operations are performed:

By means of a remotely controlled device, not shown here because it does not form part of the invention, shaft 23 of the gripping device 22 is rotated by an angle such that clips 28, hitherto placed between the clips 14 and also below the latter, are placed beneath the clips 14 and vertical with respect thereto. Then within cell S the upper clips 25 of gripping device 22 are connected to a handling means, for example the hook of a travelling crane. By said handling means the device 22 is then brought into the vertical position and through the engagement of clips 28 and 14 raises the plug 2 which, via its protective ring 16, in turn raises the cover 17 separating it from the cover seat 18. The result obtained from this vertical raising operation is shown in FIG. 5*b*.

The assembly constituted by plug 2 and cover 17 is then further raised until the lower face of plug 2 is significantly above the upper face of cover seat 18 after which, by moving the travelling crane on its rails, assembly 2+17 is laterally disengaged. Funnel 44, not equipped with its bottom 51, is then fitted and the actual discharge, i.e. the extraction of the radioactive substances contained in the container towards cell S can commence. During the discharge operation dust which is given off is collected by suction devices via orifices 49, inner space 47 of funnel 44 and tubes 48.

When discharge is at an end bottom 51 is fitted into funnel 44, suction is stopped and the operations described hereinbefore are performed in the reverse order to remove funnel 44, refit the cover 17 on its seat 18 and plug 2 on the container then, after having disengaged clips 28 and 14, the container is lowered to separate it from the cover and the cover seat. The position is then that shown in FIG. 4. The adapting ring 15 is then raised and laterally disengaged, moving with it via shoulder 15' the plug protecting ring 16.

Attention is now drawn to the advantages provided by the apparatus according to the invention during said operations.

After opening the container, i.e. in the states shown in FIGS. 5*b* and 7, the upper face of the container and all the outer faces thereof are protected against contamination by adapting ring 15 and gaskets 33 and 34. All the upper part of the plug, starting from shoulder 2' and in general terms the space between plug 2 and cover 17 are protected from contamination by protective ring 16 and its joints 36 and 37.

Thus, the zones liable to come into contact with the lower cell J and which, despite the supplementary protection provided by funnel 44, risk becoming contaminated are limited to the greatest possible extent. On referring to FIG. 6 it is only possible for the following zones to become contaminated:

(a) that defined by member 17' of cover 17, seat 18, joint 31 and joint 36 (zone 41);

(b) that defined by rings 15 and 16 and joints 36 and 37;

(c) that defined by plug 2, the part of the container and joints 33, 35 and 37.

With respect to zone (a) it is treated when, after resealing the container, the various components are in the respective positions of FIG. 7, i.e. before removing the resealed container. This treatment takes place by injecting via not shown pipes sealingly connected to orifices 39 a fluid into the circuit constituted by orifice 39, cavity 38, channels 40, zone 41, channels 42 and the pipes sealingly connected to orifices 43, whereby said fluid can be either a gas or a liquid. In the case of a gas or a liquid said fluid is circulated in accordance with the arrows F and takes place at maximum speed so as to bring about a decontamination of zone (a) or 41 by a washing or scavenging action displacing the radioactive particles into a remote area of cell J where they no longer represent any danger. It is also possible to use a viscous liquid, such as a special grease, which is forced into the circuit in the direction of arrows F and whose function is to seal the circuit and in particular zone (a) or 41, whilst coating the radioactive particles and removing them from cell J. Thus, after injecting a sufficient quantity of grease zone (a) or 41 would be filled with non-contaminated grease.

Figure 8:
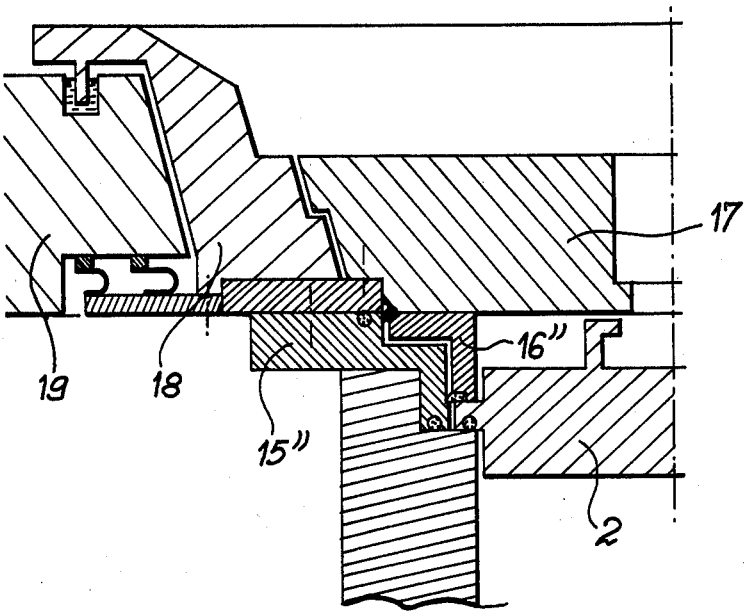
FIG. 8 the receptacle which can be fitted when the container is absent.
Figure 8:
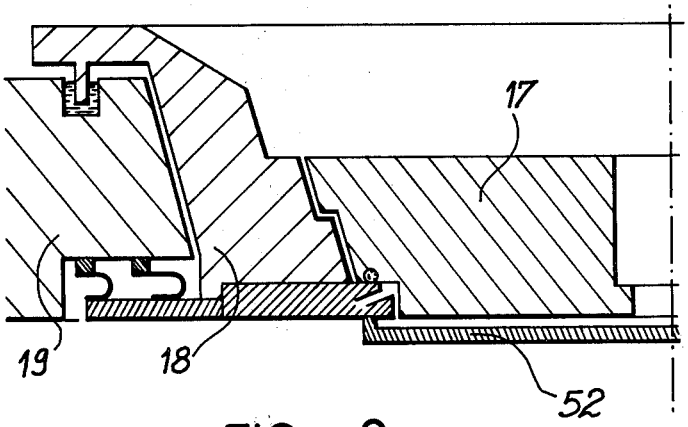

As a supplementary precaution for preventing any spreading to cell J of possible contamination of zone (a) or 41 a sheet metal receptacle 52 can be placed beneath the cover and its seat when no container is being discharged (cf FIG. 8).

With respect to zone b) the radioactive contamination which can be introduced into it is confined within said tight zone and as rings 15 and 16 remain assembled during the removal thereof the assembly formed by them can be transported without any risk of the contamination being spread towards a special workshop where rings 15 and 16 undergo conventional decontamination treatment.

Finally only zone (c), whose dimensions are extremely small, has to be decontaminated in situ.

It is possible that after a long time and following numerous operating cycles and despite the presence of joints 29, 30, 31 and 32 that members 17' and 18' may become contaminated, particularly at their interface. When there is no container, i.e. with the lower faces of the cover and its seat disengaged, ring 18' and ring 17' resting thereon are withdrawn downwards without being disassembled. These members are then sent to the decontamination workshop and are replaced by clean members.

The combination formed by the double bellows 21 and hydraulic joint 20 also ensures that contamination is not spread. Thus, the use of a double bellows 21 permits the testing of the sealing of the two individual bellows by a vacuum connection, normally sealed by a sealing plug 21' located between them. The presence of the hydraulic joint also makes it possible to protect from contamination the space between said joint and the bellows, thereby permitting the safe replacement of said bellows if they become defective. Obviously the hydraulic joint 20 is equipped with per se known devices (e.g. a constant level supply) in order to maintain its effectiveness in all conditions.

As can be gathered from what has been stated hereinbefore the apparatus according to the invention makes it possible to prevent in a satisfactory manner the spreading of radioactive contamination during operations linked with dry discharge.

To a large extent this apparatus also permits the treatment of containers of different types and in particular with different dimensions. Assuming that the apparatus as used in FIG. 5*a* corresponds to the maximum diameter of containers liable to be treated, FIG. 5'*a* shows how this apparatus can be used for smaller diameter containers. It is only necessary to modify somewhat the shapes of the adapting and protective rings, the protective ring having in particular adiametrical cross-section instead of being rectangular as in FIG. 5*a*, whilst in FIG. 5'*a* version 16'' is in square form, whilst the adapting ring in its version 15'' is correspondingly modified.

With regard to the height differences between the containers no problem is caused as a result of the solution according to the invention which provides for the engagement of the upper part of the container against the cover and its seat. Beneath floor 19 it is merely necessary to provide a sufficient free height for the highest containers and to provide a lifting travel which is adequate for the trolley carrying the container during engagement, unless preference is given to the use of several types of trolleys.

Obviously the invention is not limited to the embodiments described and represented hereinbefore and various modifications can be made thereto, particularly with regard to the location of the joints, without passing beyond the scope of the invention.

What is claimed is:

1. A joining apparatus between an orifice provided in an upper part of a container this orifice being equipped with a plug having clip means thereon, and an orifice in an horizontal wall in the lower part of a discharge enclosure, said wall being above said container, and apparatus comprising at an upper part of the container an adapting ring fitted about said container orifice and positioned with respect to said orifice of said wall, a protective ring for said plug the protective ring resting both on a shoulder of the adapting ring and on a shoulder of the container plug, a detachable cover closing said orifice of said wall, said detachable cover including relatively movable gripping means and resting on a cover seat connected to said wall of said discharge enclosure, said gripping means being able to seize said clip means of said plug of said container to simultaneously raise said plug and said cover to provide communication between said container and said discharge enclosure.

2. An apparatus according to claim 1, wherein said cover seat is connected by a deformable sealing means to said wall of said discharge enclosure, the cover being provided in its median zone with said gripping means which traverses it in a tight manner while being able to slide vertically with respect to the cover in such a way that it is able to seize said clip means of said plug of a container centered below the cover and whose protective ring is in contact at an upper face with a lower face of the cover and is able to raise the plug at the same time as the cover which rests thereon by means of the protective ring, joints being placed between the container and the adapting ring and between the adapting ring and the cover seat to protect an upper part and outer faces of the container from contamination, at least two other joints are placed between the protective ring and the adapting ring, together with the plug and the cover in order to confine any contamination to an interface of the two rings and prevent any contamination of the upper part of the plug and a space defined by said plug, the cover and the protective ring, other joints being provided between the cover and seat so as to confine to the greatest extent possible any contamination to an interface of the cover and seat, means also being provided to flush with a fluid an unconfined portion of an interface space between the cover and the cover seat and a funnel with a detachable bottom to protect inner faces of the cover seat and the adapting ring during discharge and a receptacle can be placed beneath the cover and seat when the container is absent.

3. An apparatus according to claim 2, wherein the deformable sealing means connecting the cover seat to the wall comprise a hydraulic joint located close to the upper face of the wall and a double bellows located close to the lower face of the floor.

4. An apparatus according to claim 2, wherein the joints mounted between the protective ring and the adapting ring are lipped joints, each of which ensures the reciprocal sealing of the three different parts when the container is sealed.

5. An apparatus according to claim 2, wherein the means for flushing said unconfined portion of said interface between the cover and the cover seat comprise a circuit of channels connecting two faces of the wall across the adapting ring and the cover seat circulating fluid in these channels.

6. An apparatus according to claim 5, wherein the fluid is a gas.

7. An apparatus according to claim 5, wherein the fluid is a liquid.

8. An apparatus according to claim 5, wherein the fluid is a viscous liquid grease.

9. An apparatus according to claim 5, wherein the the circuit of channels cooperates with a funnel having a double wall providing an inner space connected by at least one tube to at least one suction device, air intakes being provided in the inner wall of the funnel, and a lower end for the funnel having a ledge able to support a detachable bottom.

10. An apparatus according to claim 1, wherein the cover and the cover seat respectively have at their interface two joined rings whereby said two joined rings can be removed downwards when no container is present, the first ring resting on the second ring, while at least one gasket is provided between each of said joined rings and the corresponding cover and cover seat.

11. An apparatus according to claim 1, wherein the gripping means is constituted by a circular shaft traversing the cover and carrying a sleeve in which it may rotate but not slide, being tightly sealed with respect to said sleeve by at least one joint, while the sleeve can slide but not rotate with respect to the cover by at least one bellows, an upper end of the shaft being provided with clips which can engage with a handling means placed above the floor, while a lower end of the shaft is provided with clips which are able to engage with said clip means fixed to the container plug.

12. A joining apparatus between a container having an orifice equipped in its upper part with a plug for said orifice and a horizontal wall of a discharge enclosure provided with a orifice in a lower part thereof and located above said container, wherein the container is provided in an upper part with an adapting ring fitted about said container orifice and positioned with respect to said wall and a protective ring for the plug, said discharge enclosure orifice being sealed by a detachable cover having relatively movable gripping means and resting on a cover seat connected to said wall of the discharge enclosure, said protective ring resting both on a shoulder of the adapting ring and on a shoulder of the container plug, said cover seat is connected by a deformable sealing means to said wall of said discharge enclosure, said cover being provided in its median zone with gripping means which traverses said cover in a tight manner while being able to slide vertically with respect to the cover in such a way that said gripping means is able to seize the plug of a container centered below the cover and whose protective ring is in contact at an upper face with a lower face of the cover and is able to raise the plug at the same time as the cover which rests thereon by means of the protective ring, joints being placed between the container and the adapting ring and between the adapting ring and the cover seat to protect an upper part and outer faces of the container from contamination, while at least two other joints are placed between the protective ring and the adapting ring, together with the plug and the cover in order to confine any contamination to an interface of the two rings and prevent any contamination of the upper part of the plug and a space defined by said plug, the cover and the protective ring, other joints being provided between the cover and seat so as to confine to the greatest extent possible any contamination to an interface of the cover and seat, means for flushing with a fluid an unconfined portion of an interface space between the cover and the cover seat, a funnel with a detachable bottom to protect inner faces of the cover seat and the adapting ring during discharge and a receptacle beneath the cover and seat when the container is absent.

* * * * *